US008367979B2

(12) United States Patent
Oyler et al.

(10) Patent No.: US 8,367,979 B2
(45) Date of Patent: Feb. 5, 2013

(54) COOKING PLATFORM AND RELATED METHOD

(75) Inventors: Max Douglas Oyler, Louisville, KY (US); Siva Kiran Chekka, Louisville, KY (US)

(73) Assignee: General Electric Company, Schenectady, NY (US)

( * ) Notice: Subject to any disclaimer, the term of this patent is extended or adjusted under 35 U.S.C. 154(b) by 966 days.

(21) Appl. No.: 11/845,347

(22) Filed: Aug. 27, 2007

(65) Prior Publication Data

US 2009/0057292 A1 Mar. 5, 2009

(51) Int. Cl.
*A21B 1/22* (2006.01)
*H05B 3/02* (2006.01)

(52) U.S. Cl. ..... 219/394; 219/412; 219/395; 219/485; 219/486; 219/487; 219/508; 219/398; 219/414; 219/446.1

(58) Field of Classification Search ..... 219/412, 219/395, 485–7, 497, 508, 394, 398, 414, 219/446.1
See application file for complete search history.

(56) References Cited

U.S. PATENT DOCUMENTS

| | | | | |
|---|---|---|---|---|
| 2,932,715 | A | 4/1960 | Weeks | |
| 4,196,330 | A | 4/1980 | Payne | |
| 4,198,553 | A | 4/1980 | Dills | |
| 4,469,926 | A | 9/1984 | Komuro | |
| 4,695,738 | A | 9/1987 | Wilmot | |
| 4,798,927 | A | 1/1989 | Kaminaka | |
| 4,918,291 | A | 4/1990 | Higgins et al. | |
| 5,695,668 | A * | 12/1997 | Boddy | 219/400 |
| 6,157,008 | A * | 12/2000 | Brown et al. | 219/486 |
| 6,191,391 | B1 | 2/2001 | Deo et al. | |
| 6,700,101 | B2 | 3/2004 | Decesari et al. | |
| 6,849,835 | B2 | 2/2005 | Bollmers et al. | |
| 6,943,324 | B2 * | 9/2005 | Ahuja | 219/446.1 |
| 7,041,940 | B2 * | 5/2006 | Bakanowski et al. | 219/412 |

* cited by examiner

*Primary Examiner* — Shawntina Fuqua
(74) *Attorney, Agent, or Firm* — GE Global Patent Operation; Peter T. DiMauro

(57) ABSTRACT

A household range includes a first oven having a first electric cooking element, and a second oven includes a second electric cooking element. A power management system is used to distribute power such that when the second electric cooking element is energized the first electric cooking element is de-energized.

9 Claims, 4 Drawing Sheets

COOKING PLATFORM AND RELATED METHOD

BACKGROUND OF THE INVENTION

This invention relates generally to a power management system and method, and more particularly, to a power management system and method for a cooking platform.

There exist different types of cooking platforms, which incorporate various appliances that can be activated individually or simultaneously. For example, a typical electric household range includes an oven and generally four surface heating elements. Once the cooking platform is connected within a household, there will be a preset power supply limit available for use by the cooking platform. In most instances, there exist building codes, which must be adhered to in wiring for such a cooking platforms, so that the available power supply is typically pre-established.

In view of the above, the appliances within the cooking platform (e.g., the oven and surface heating elements) have associated power consumption levels that should not collectively exceed the available power supply to the cooking platform. In this manner, it is assured that all of the appliances in the cooking platform can be simultaneously activated without overloading the electrical circuitry and tripping a breaker. However, from a practical standpoint, it is actually quite rare that all of the appliances will require activation at the same time.

Versatility and other benefits can be made available to a consumer if the cooking platform incorporated additional high-powered appliances, even if these appliances were to collectively exceed the available power supply limit if simultaneously activated. For instance, in the case of a gas household range, it may be advantageous to increase the available upper power input for the oven and/or the surface burners, or to even incorporate a second oven unit as part of the overall range or to also include a convection element. Without correspondingly decreasing the power rating of the individual appliances to safeguard against a system overload, these design changes are not available.

BRIEF DESCRIPTION OF THE INVENTION

As described herein, embodiments of the invention overcome one or more of the above or other disadvantages known in the art.

In one aspect, a cooking platform includes a first oven having a first electric cooking element, and a second oven includes a second electric cooking element. A power management system is used to distribute power such that when the second electric cooking element is energized the first electric cooking element is de-energized.

In another aspect, a cooking platform includes a first oven having a first electric cooking element, and a second oven including a second electric cooking element. Means are used for distributing power such that when the second electric cooking element is energized the first electric cooking element is de-energized.

In another aspect, a method of distributing power between a first electric cooking element in a first oven and a second electric cooking element in a second oven includes energizing the first electric cooking element, and de-energizing the first electric cooking element when the second electric cooking element is energized.

BRIEF DESCRIPTION OF THE DRAWINGS

The following figures illustrate examples of embodiments of the invention. The figures are described in detail below.

DETAILED DESCRIPTION OF THE INVENTION

Embodiments of the invention are described below, with reference to the figures. Throughout the figures, like reference numbers indicate the same or similar components.

Figure 1:
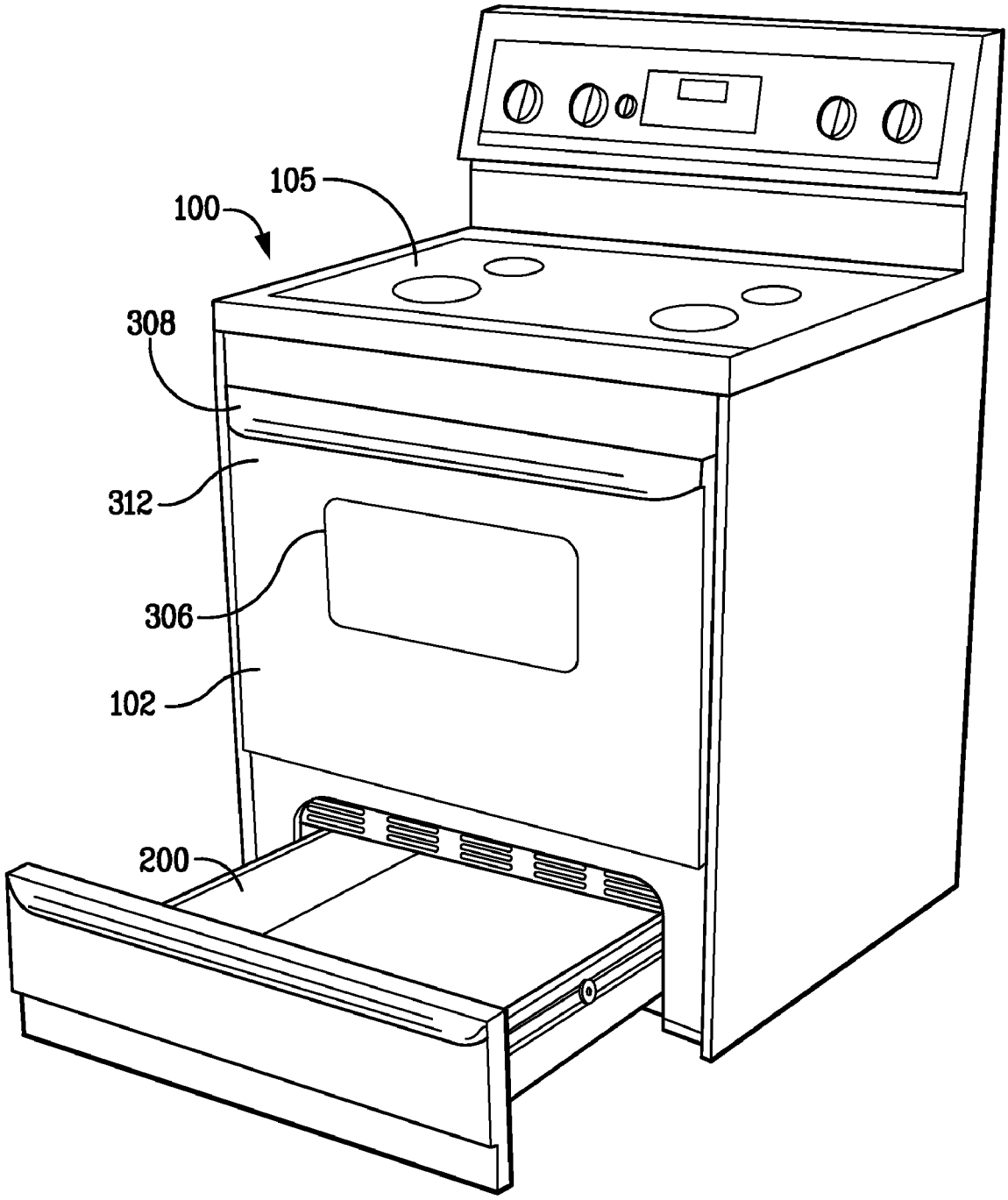
FIG. 1 is a perspective view of a cooking platform in which a power management system and method is implemented.
Figure 2:
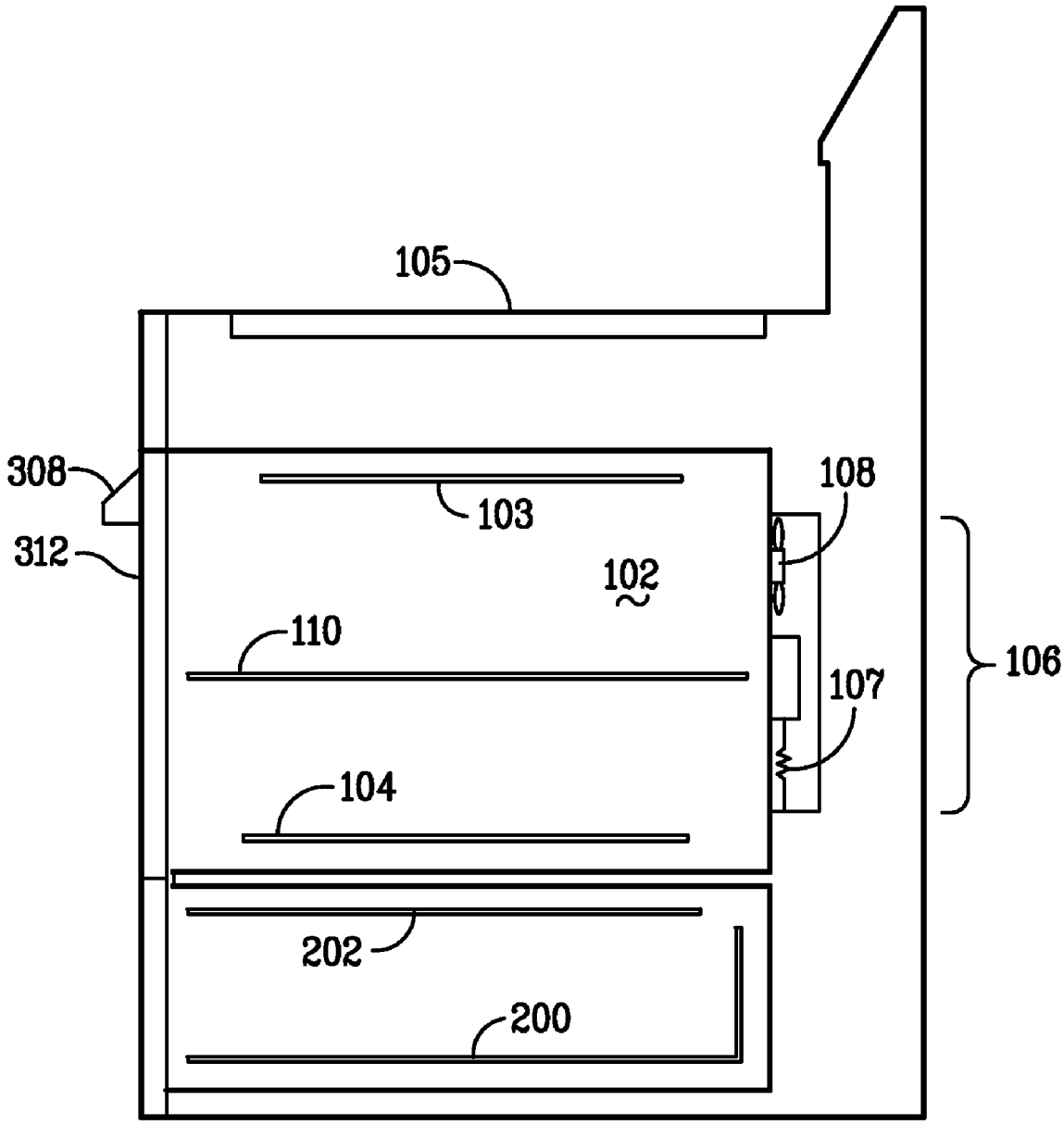
FIG. 2 is a side cross-sectional view of the cooking platform of FIG. 1.

FIG. 1 is a perspective view of a cooking platform in which a power management system and method is implemented, and FIG. 2 is a side cross-sectional view of the cooking platform of FIG. 1. In the embodiment shown in the figures, the cooking platform 100 includes a first oven 102 and a second oven 200. The cooking platform 100 is illustrated as a freestanding range oven, while the first oven 102 is shown as a gas oven with an electric cooking element 106 which is located above the second oven 200 that is shown as a baking drawer with an electric cooking element 202. It is to be understood, however, that the cooking platform 100 is not limited to a free standing range, the first oven 102 is not limited to a gas oven with an electric cooking element, and the second oven 200 is not limited to a baking drawer with an electric cooking element. Rather, embodiments of the invention can be used with any cooking appliance that includes multiple electric elements to which the distribution of power is to be managed.

As shown in the figures, the cooking platform 100 also includes an electric cooking element 105. Examples of the electric cooking element 105 include a plurality of cook top elements, sometimes referred to as surface elements or burner elements, located above or below a glass or ceramic surface. It is to be understood, however, that the electric cooking element 105 is not limited to a cook top element, and the electric cooking element 105 can be omitted from the cooking platform 100 or may be a gas cooking element.

In the embodiment shown in the figures, a door 312 of the cooking platform 100 allows and prohibits access to the first oven 102. A handle 308 is used to open and to close the door 312. A window 306 located on the door 312 allows the user to see food, for example, which is placed inside the first oven 102. It is to be understood, however, that any or all of these elements are not required to be included in the cooking platform 100, and that alternate or additional structure can be used to allow and prohibit access to the first oven 102.

As shown in the figures, the first oven 102 includes one or more racks 110 on which the food is placed. An electric broil element 103 is located at a top end inside the first oven 102 and a gas cooking element 104 is located at a bottom end inside the first oven 102. It is to be understood, however, that any or all of these elements are not required to be included in the cooking platform 100.

In embodiments of the invention, the distribution of power is managed between the electric cooking elements 106 and 202 of the first and second ovens 102 and 200. This arrangement allows simultaneous use of the electric cooking elements 106 and 202 by switching power between the elements 106 and 202, as discussed below. The electric cooking element 106 is shown as including a convection heating element 107 and a convection fan 108. The components of the electric cooking element 106, including the convection heating element 107 and convection fan 108, are located at a back end inside the first oven 102 in the embodiment shown in the drawings, although these components can be located in other places in the cooking platform 100. The convection heating element 107 generates convective heat energy by electric resistance. The convective heat energy is more evenly distributed inside the first oven 102 by energization of the convection fan 108, thereby speed-cooking food items placed on the rack 110 in the first oven 102. It is to be understood, however, that the electric cooking element 106 can include one or more of another type of speed-cooking element such as a microwave generator or a broil element, in addition to or in place of the convection heating element 107, and can include or omit the convection fan 108.

As shown in the figures, the electric cooking element 202 is located in the second oven 200, which in turn is located below the first oven 102. The use of the second oven 200 as a baking drawer permits baking or heating to take place in the second oven 200 when baking, heating, cooking or no operation takes place in the first oven 102. The figures show the electric cooking element 202 as an electric heating element that generates heat energy by electric resistance. It is to be understood, however, that the electric cooking element 202 can include one or more of a speed-cooking element such as a microwave generator, a convection element or a broil element, and a convection fan used to distribute hot air around food to cook the food, in addition to or in place of the electric heating element.

Figure 3:
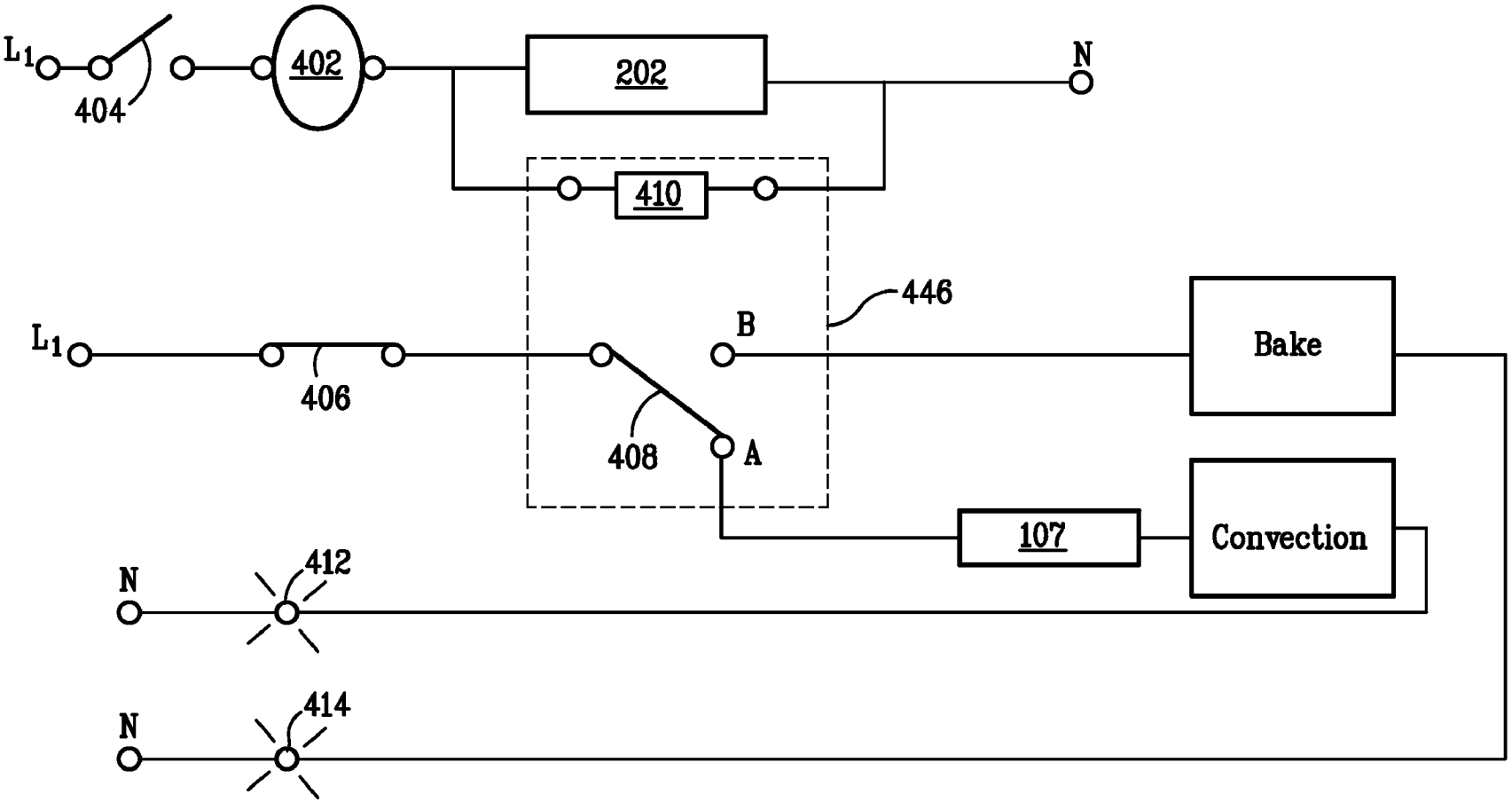
FIG. 3 is a schematic diagram of the power management system of FIG. 1.

FIG. 3 is a schematic diagram of an embodiment of a power management system 400, which can be used to distribute power between the electric cooking elements 106 and 202, and more particularly between the electric cooking element 202 and the convection heating element 107 of the electric cooking element 106.

In the embodiment shown in the figure, the power management system 400 includes a controller 446, a thermostat 402, a coil 410 and switches 404, 406 and 408.

FIG. 3 shows a mode of operation in which the second oven 200 is not in use, so that the switch 404 is in a normally open position. As a result, the thermostat 402, the electric cooking element 202 and the coil 410 are de-energized. The switch 408 remains in normal position A. Thus, during this mode of operation, power is not distributed between the convection heating element 107 and the electric cooking element 202.

In the mode of operation shown in FIG. 3, the first oven 102 is available for use. When the normally open switch 406 is closed, as shown in the figure, the normal positioning of the switch 408 permits energization of the convection heating element 107 in the first oven 102. Although not required, this illuminates a light 412 indicating that the convection heating element 107 is energized.

In a second mode of operation (which although not shown in FIG. 3 is understood in view of the following description), the second oven 200 is available for use, such that when the electric cooking element 202 is energized, the convection heating element 107 is de-energized. Specifically, when the normally open switch 404 is closed, the thermostat 402 allows the electric cooking element 202 to be energized. When the electric cooking element 202 is energized, the coil 410 draws the switch 408 from the normal position A to a position B. When the switch 408 is in the position B, the convection heating element 107 is de-energized. Although not required, a light 414 is illuminated, indicating that the electric cooking element 202 is energized.

In order to maintain a temperature within the first oven 102, when the convection heating element 107 is de-energized, for example, heating or cooking within the first oven 102 can occur through operation of another heating element that can be operated without exceeding power limitations for the cooking platform 100.

The above-discussed arrangement allows each of the electric cooking element 202 and the convection heating element 107 to be rated for the maximum wattage of the cooking platform 100. The maximum wattage of the cooking platform 100 is a maximum wattage at which the electric cooking element 202 could operate without considering operation of the convection heating element 107, and vice-versa.

For example, a typical gas range installation must have the maximum installed current draw below 15 A. In a cooking platform according to the present invention, both an electric convection element (1400 W @ 120V=11.7 A) and an electric baking drawer element (1200 W @ 120V=10 A) are present. Reduction of either to allow the combination of amperes to be below 15 A would result in unsatisfactory performance of one or both of the systems. Therefore, if both elements are concurrently energized the combination would exceed the rating for the electrical outlet and will trip the 15 A circuit breaker. This will result in an unsatisfied consumer. This problem is avoided by the disclosed power management system, for the reasons discussed above.

Figure 4:
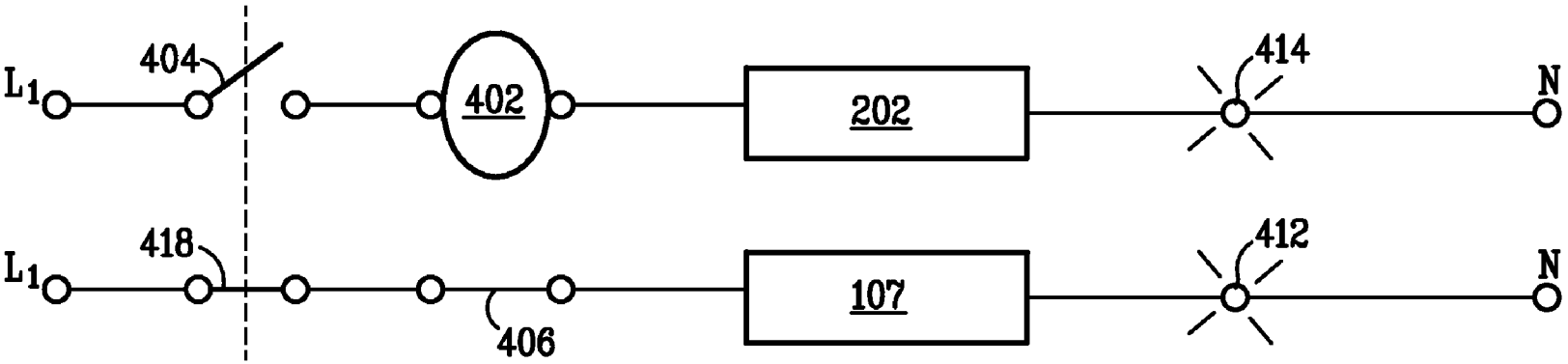
FIG. 4 is a schematic diagram of an alternate embodiment of a power management system for the cooking platform of FIG. 1.

In an alternate embodiment, as shown in FIG. 4, a normally closed switch 418 is interconnected with the normally open switch 404, such that when the switch 404 is closed the switch 418 becomes open. When in the mode of operation shown in the figure, the second oven 200 is not in use and the normally open switch 406 is closed, thereby energizing the convection heating element 107 when the first oven 102 is in use. Although not required, the light 412 is illuminated, indicating that the convection heating element 107 is energized.

In a second mode of operation of the alternate embodiment (which although not shown in FIG. 4 is understood in view of the following description), the second oven 200 is in use and the electric cooking element 202 is energized, and the convection heating element 107 is de-energized. Specifically, when the normally open switch 404 is closed the normally closed switch 418 is opened. This allows the electric cooking element 202 to become energized when the thermostat 402 closes calling for heat. Although not required, the light 414 is illuminated, indicating that the electric cooking element 202 is energized.

Figure 5:
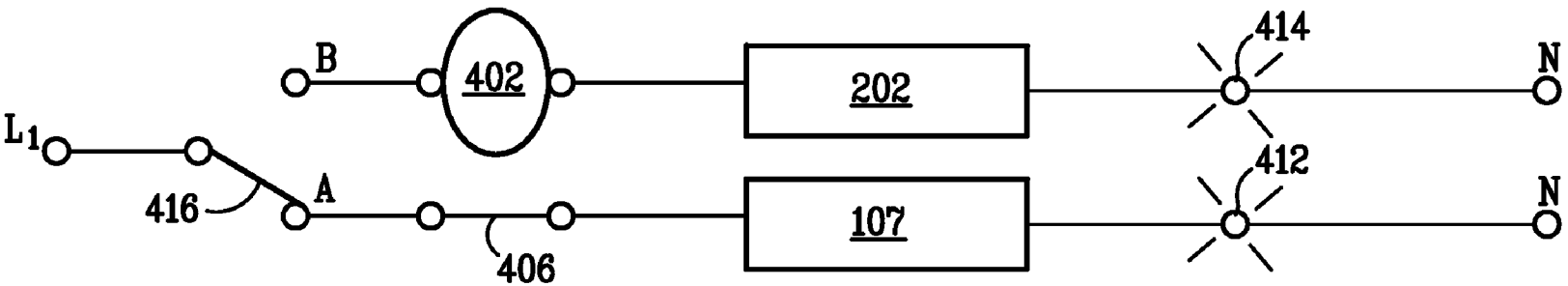
FIG. 5 is a schematic diagram of another alternate embodiment of a power management system for the cooking platform of FIG. 1.

In another alternate embodiment, as shown in FIG. 5, a switch 416 is a Single Pole Double Throw relay or switch (known as SPDT). When in the mode of operation shown in the figure, the bake drawer 200 is not in use and the SPDT switch 416 is in a position A, thereby energizing convection heating element 107 when the normally open switch 406 is closed while the first oven 102 is in use. Although not required, the light 412 is illuminated, indicating that the convection heating element 107 is energized. It is to be understood that the switches in the power management system can be replaced with this SPDT relay that can meet the power sharing operation.

In a second mode of operation of the other alternate embodiment (which although not shown in FIG. 5 is understood in view of the following description), the second oven 200 is in use and electric cooking element 202 is energized, and the convection heating element 107 is de-energized. Specifically, when the SPDT switch 416 is in a position B, the electric cooking element 202 becomes energized when the thermostat 402 closes calling for heat. Although not required, the light 414 is illuminated, indicating that the electric cooking element 202 is energized.

This written description uses examples to disclose embodiments of the invention, including the best mode, and to enable a person of ordinary skill in the art to make and use embodiments of the invention. It is understood that the patentable scope of embodiments of the invention is defined by the claims, and can include additional components occurring to those skilled in the art. Such other arrangements are understood to be within the scope of the claims.

What is claimed is:

1. A cooking platform comprising:

a first oven comprising a first electric cooking element and a gas cooking element;

a second oven comprising a second electric cooking element; and a power management system configured to distribute power such that when the second electric cooking element is energized the first electric cooking element is de-energized, the power management system configured to operate each of the first and second electric cooking elements independently up to a maximum power consumption limit of the cooking platform, wherein the cooking platform has a first mode of operation in which the first electric cooking element is available to be energized when the second electric cooking element is de-energized, and wherein the cooking platform has a second mode of operation in which the second electric cooking element is available to be energized and the gas cooking element is available to be operated when the first electric cooking element is de-energized.

2. The cooking platform according to claim 1, wherein the first electric cooking element comprises a convection heating element.

3. The cooking platform according to claim 1, wherein the power management system is configured to operate each of the first and second electric cooking elements at a maximum power consumption limit corresponding to a 15 ampere circuit rating.

4. The cooking platform according to claim 1, wherein the power management system comprises a coil and first and second switches, and wherein closing the first switch energizes the second electric cooking element and the coil, the energized coil switching the second switch to de-energize the first electric cooking element.

5. The cooking platform according to claim 4, wherein the power management system comprises a thermostat, and wherein closing the first switch energizes the second electric cooking element and the coil in response to a signal from the thermostat, the energized coil switching the second switch to de-energize the first electric cooking element.

6. The cooking platform according to claim 3, wherein the power management system comprises a single pole double throw relay, and wherein positioning the relay in a first position energizes the first electric cooking element and de-energizes the second electric cooking element, and positioning the relay in a second position energizes the second electric cooking element and de-energizes the first electric cooking element.

7. The cooking platform according to claim 3, wherein the power management system comprises first and second switches, and wherein closing the first switch energizes the second electric cooking element and opens the second switch to de-energize the first electric cooking element.

8. A method of distributing power between a first electric cooking element in a first oven of a cooking platform and a second electric cooking element in a second oven of the cooking platform, wherein the first oven further comprises a gas cooking element and the first electric cooking element comprises a convection heating element, the method comprising:

energizing the first electric cooking element up to a maximum power consumption limit of the cooking platform; and de-energizing the first electric cooking element when the second electric cooking element is energized;

wherein the first and second electric cooking elements are independently operable to a maximum power consumption limit of the cooking platform; and wherein when the first electric cooking elements is de-energized, said gas cooking element in the first oven is operated.

9. The method of claim 8, wherein energizing the first electric cooking element comprises closing a first normally open switch and distributing power through a second switch to the first electric cooking element.

* * * * *